US006929553B1

(12) United States Patent
Diemert

(10) Patent No.: US 6,929,553 B1
(45) Date of Patent: Aug. 16, 2005

(54) WHEELCHAIR GLIDER

(76) Inventor: Kelcey Diemert, 96 3rd St., Chinook, MT (US) 58523

( * ) Notice: Subject to any disclaimer, the term of this patent is extended or adjusted under 35 U.S.C. 154(b) by 120 days.

(21) Appl. No.: 10/636,832

(22) Filed: Aug. 7, 2003

Related U.S. Application Data

(60) Provisional application No. 60/401,335, filed on Aug. 7, 2002.

(51) Int. Cl.[7] ..... A63G 9/12

(52) U.S. Cl. ..... 472/118; 472/121; 14/69.5; 482/51

(58) Field of Search ..... 472/14, 28, 29, 472/32, 35, 59, 116, 118, 88, 89, 121; 14/69.5; 482/51, 54, 66

(56) References Cited

U.S. PATENT DOCUMENTS 1,906,768 A * 5/1933 Romine ..... 472/118
2,497,372 A * 2/1950 Pricer ..... 472/29
2,616,485 A * 11/1952 Robbins ..... 472/125
4,779,863 A * 10/1988 Yang ..... 482/51
5,496,235 A * 3/1996 Stevens ..... 482/51
5,616,103 A * 4/1997 Lee ..... 482/51
5,884,563 A * 3/1999 Sheldon et al. ..... 104/53
5,935,011 A * 8/1999 Morgan et al. ..... 472/29
5,938,283 A * 8/1999 Babcock et al. ..... 297/273
6,149,528 A * 11/2000 Volz et al. ..... 472/43
6,171,198 B1 * 1/2001 Lizama Troncoso et al. . 472/29

* cited by examiner

*Primary Examiner*—Kien Nguyen

(57) ABSTRACT

A wheelchair glider is provided having a frame assembly and a platform swingingly suspended substantially horizontally within the frame assembly by a swing arm assembly, the platform being configured to support at least one wheelchair thereon, including wheelchairs of various sizes and configurations, the glider optionally being provided with one or more ramps for loading and unloading a wheelchair, and one or more handlebars and/or a footrest for a user in a wheelchair to manually bias the platform in a back and forth swinging motion relative to the frame assembly.

18 Claims, 2 Drawing Sheets

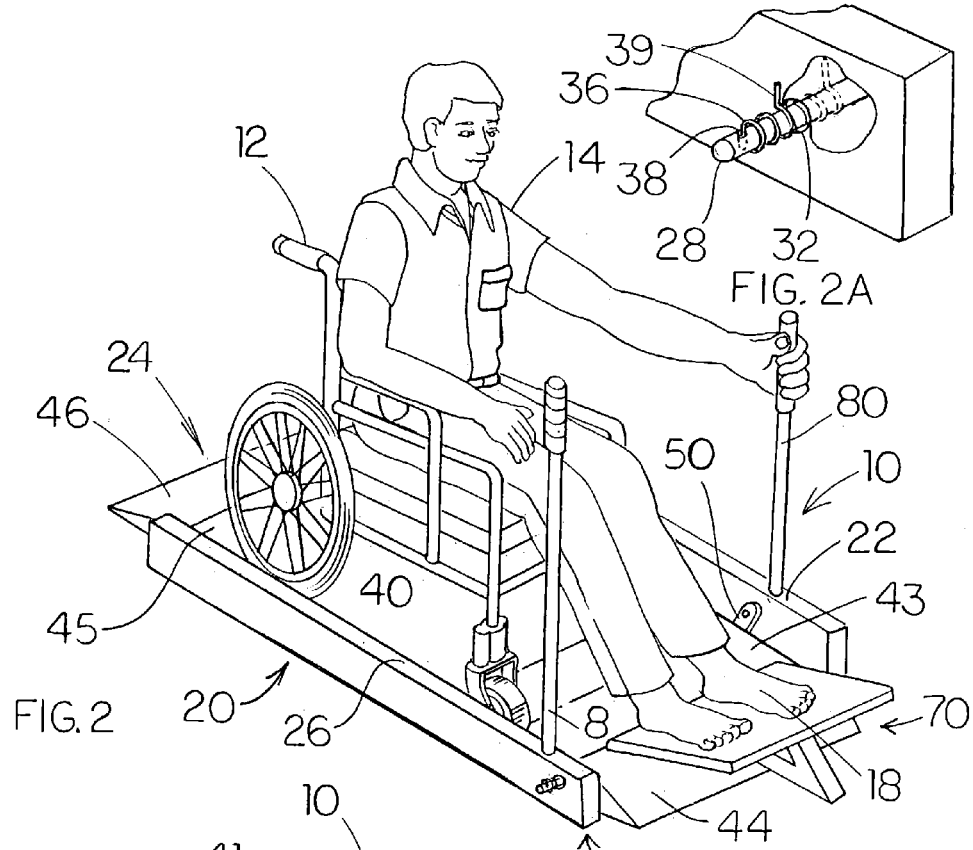
FIG. 2A
FIG. 2
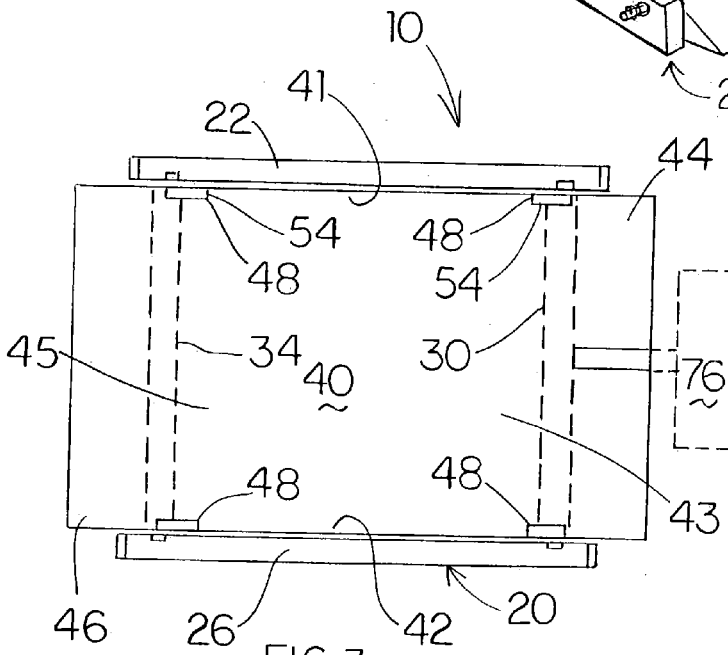
FIG. 3
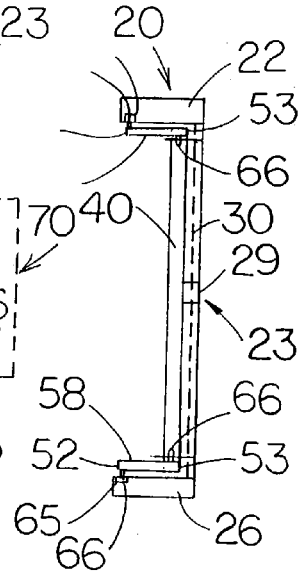
FIG. 5

WHEELCHAIR GLIDER

This application claims priority based on U.S. Provisional Patent Application Ser. No. 60/401,335, entitled "Wheelchair Glider," and filed on Aug. 7, 2002.

BRIEF DESCRIPTION OF THE DRAWINGS

FIG. 2 is a front perspective view of the wheelchair glider having a wheelchair thereon and a user in the wheelchair having his hands and feet positioned to glide the platform back and forth;

FIG. 2A is an enlarged, fragmentary, broken-away, exploded view of the frame members showing the pivot rod 28 in bores 32 and the spring 36 by which the ramps 44, 46 are pivotally connected and biased into an upward position;

FIG. 3 is a top view of the wheelchair glider;

FIG. 5 is an end view of the wheelchair glider from the front end of the frame assembly.

DETAILED DESCRIPTION OF EMBODIMENTS OF THE INVENTION

Figure 1:
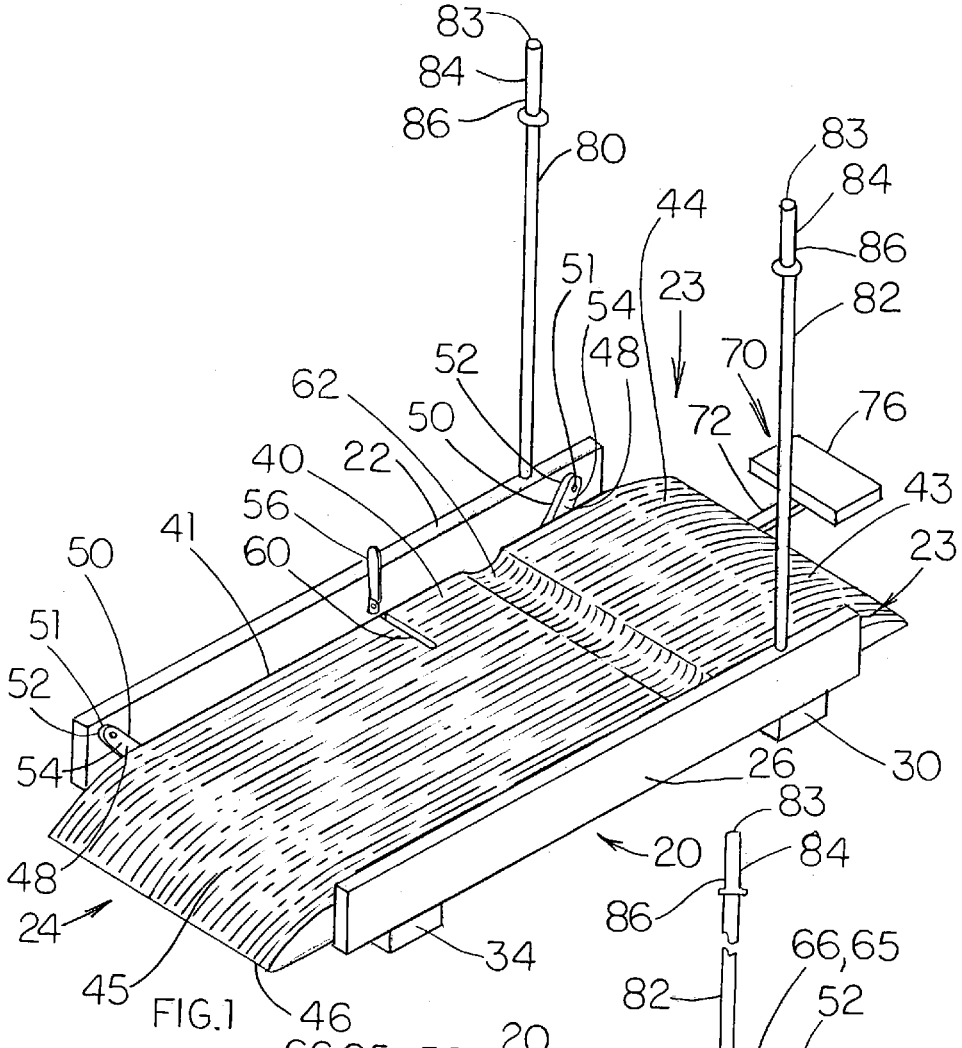
FIG. 1 is a rear perspective view of the wheelchair glider without a wheelchair thereon.
Figure 4:
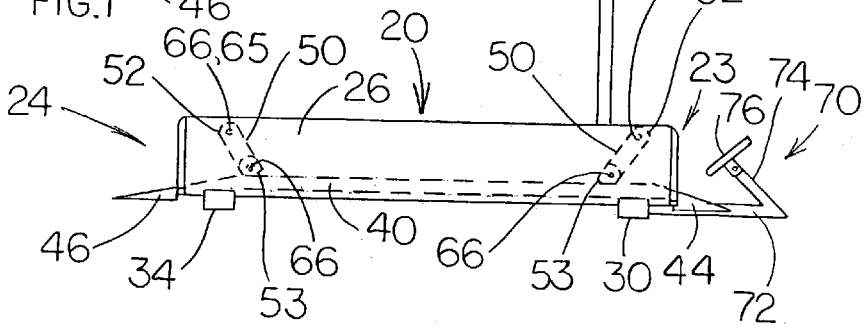
FIG. 4 is a side view of the wheelchair glider.

Embodiments of a wheelchair glider 10 are disclosed herein having a frame assembly 20 and a platform 40 swingingly suspended substantially horizontally within the frame assembly by a swing arm assembly 48. The platform 40 is configured to support at least one wheelchair 12 thereon, including wheelchairs of various sizes and configurations.

The frame assembly 20 comprises a front end 23 and a rear end 24. In one embodiment, the frame assembly 20 comprises a first frame member 22 and a second frame member 26 fixed in substantially parallel spaced relation to each other by at least a first cross brace 30 extending between the first and second frame members 22, 26. In yet other embodiments, the frame assembly further comprises a second cross brace 34 extending between the first and second frame members 22, 26. The first and second frame members 22, 26 are spaced apart by first and second cross braces 30, 34 a distance sufficient to accommodate therebetween the platform 40 swingingly suspended therefrom by the swing arm assembly 48.

The platform 40 is swingingly suspended within the frame assembly 20 to enable the platform to swing back and forth in substantial alignment with the front end 23 and the rear end 24 of the frame assembly. In one embodiment, at least one ramp is provided at either a front end 43 or a rear end 45 of the platform 40 for loading and unloading a wheelchair onto and from the platform 40. In other embodiments, the wheelchair glider 10 comprises a front ramp 44 positioned at the front end 43 of the platform 40 and a rear ramp 46 positioned at the rear end 45 of the platform 40. In yet other embodiments, the ramps 44, 46 are secured to the ends 43, 45 of the platform 40 and have sufficient clearance above the surface on which the wheelchair glider 10 sits to allow the platform 40 to swing substantially freely. In yet other embodiments, the ramps 44, 46 are pivotally secured between the first frame member 22 and the second frame member 26. See FIG. 2A. The ramps 44 and 46 are secured to a pivot rod 28 which is journaled in bores 32 in each of the first and second frame members 22, 26. Within the bores 32 there is a coil spring 36 having opposite ends 38, 39. The interior end 38 is positioned within a radially extending bore within the pivot rod 28. The exterior end is secured within a radially extending bore within the first and second frame members 22, 26. Spring 36 biases the ramps 44 and 46 upwardly until the ramp impinges with platform 40 to space the ramp from the surface supporting the glider 10. The clearance above the surface on which the wheelchair glider 10 sits allows the platform 40 to swing substantially freely when the ramps 44 and 46 are in their upward position. However, when a wheelchair engages either ramp, the ramps pivotally rotate downwardly to contact the surface supporting the wheelchair glider 10 to allow the wheelchair to smoothly traverse the ramp onto the platform 40 or onto the surface or off the platform 40.

In yet other embodiments, ramps 44, 46 are removable from platform 40 when not in use. In yet other embodiments, the ramps 44, 46 are configured to allow a wheelchair 12 to be loaded onto the platform 40 at the rear end 45 and unloaded from the platform 40 at the front end 43 such that the wheelchair 12 is not required to travel in reverse or to be turned around while on the platform 40.

In one embodiment, the swing arm assembly 48 comprises a plurality of swing arms 50 connecting the platform 40 to the frame assembly 20. In other embodiments, a plurality of laterally spaced apart left side swing arms 54 connect the left side 41 of the platform 40 to the first frame member 22, and a plurality of laterally spaced apart right side swing arms 58 connect the right side 42 of the platform 40 to the second frame member 26. In yet other embodiments, each swing arm comprises a top end 52 and a lower end 53.

In one embodiment, the top end 52 of each left side swing arm 54 is pivotally connected to the frame assembly 20 at the first frame member 22. Similarly, the top end 52 of each right side swing arm 58 is pivotally connected to the frame assembly 20 at the second frame member 26. The lower end 53 of each left side swing arm 54 is pivotally connected to the left side 41 of the platform 40, and the lower end 53 of each right side swing arm 58 is pivotally connected to the right side 42 of the platform 40.

In one embodiment, the swing arms 50 suspends the platform 40 from the frame assembly 20 at least proximate to the front end 23 and the rear end 24. In other embodiments, at least one left side swing arm 54 has its top end 52 pivotally connected to the first frame member 22 proximate to the front end 23 of the frame assembly 20, at least one left side swing arm 54 has its top end 52 pivotally connected to the first frame member 22 proximate to the rear end 24 of the frame assembly 20, at least one right side swing arm 58 has its top end 52 pivotally connected to the second frame member 26 proximate to the front end 23 of the frame assembly 20, and at least one right side swing arm 58 has its top end 52 pivotally connected to the second frame member 26 proximate to the rear end 24 of the frame assembly 20. In yet other embodiments, the swing arm assembly 48 comprises two left side swing arms 54 and two right side swing arms 58.

Pivotal connections 51 may be provided by any means generally known in the art of pivotal connections that will permit each swing arm 50 to rotate about the location of the connection. In one embodiment, pivotal connections 51 comprise pivot pins 65 and bearings 66.

The swing arm assembly 48 may be configured to tilt the platform 40 slightly upwardly and downwardly as it swings back and forth within the frame assembly 20. In one embodiment, the lower ends 53 of the left side swing arms 54 are tilted toward each other relative to their respective top ends 52, and the lower ends 53 of the right side swing arms 58 are tilted toward each other relative to their respective top ends 52. In other embodiments, the lower ends 53 of the left side swing arms 54 are spaced apart a distance less than the distance between the top ends 52 of the left side swing arms 54, and the lower ends 53 of the right side swing arms 58 are spaced apart a distance less than the distance between the top ends 52 of the right side swing arms 58.

The swing arm assembly 48 may also be configured to maintain the platform 40 substantially horizontally at rest and as it swings back and forth within the frame assembly 20. In one embodiment, the distance between the lower ends 53 of the left side swing arms 54 is substantially equal to the distance between the top ends 52 thereof, and the distance between the lower ends 53 of the right side swing arms 58 is substantially equal to the distance between the top ends 52 thereof. In other embodiments, the swing arms 50 are aligned generally perpendicularly with the platform 40 and the first and second frame members 22, 26 when the platform 40 is at rest.

A foot rest assembly 70 may be provided at the front end 23 of the frame assembly 20 to enable a user 14 in a wheelchair 12 supported on the platform 40 to cause the platform to swing by pushing with one or both feet 18 on the foot rest assembly 70. In one embodiment, the foot rest assembly 70 comprises an assembly support member 72 and an inclined foot rest 76 connected to the assembly support member 72 by a connecting support member 74. In other embodiments, the height of the inclined foot rest 76 above the surface is adjustable by selectively adjusting the length of a telescoping support member 74 or by any other mechanical means known in the art of adjustable-height foot rests. In yet other embodiments, the foot rest assembly 70 is connected to the frame assembly 20 by positioning the distal end of support member 72 in bore 29 of first cross brace 30 and may be configured for collapsing or otherwise folding in preparation for transport or storage of the glider 10.

First and second handlebars 80, 82 may additionally be provided with the wheelchair glider 10 to enable the user 14 in a wheelchair 12 on the platform 40 to push and/or pull against one or both handlebars 80, 82 to cause the back and forth swinging of the platform 40. In one embodiment, the first and second handlebars are secured to the frame assembly 20 proximate to the front end 23. In other embodiments, the first and second handlebars 80, 82 are secured to the first and second frame members 22, 26 proximate to the front end 23 of the frame assembly 20. In yet other embodiments, the handlebars 80, 82 extend generally upwardly from the frame assembly 20. In yet other embodiments, the handlebars 80, 82 are selectively telescoping for adjusting the height of the distal ends 83 of the handlebars 80, 82 above the frame assembly 20. In yet other embodiments, the distal end 83 of each of the handlebars 80, 82 comprises a handle gripping portion 84 secured thereto. In yet other embodiments, the handle gripping portions 84 comprise a resilient handle 86 manufactured of any suitable material, such as rubber or a foam material.

The handlebars 80, 82 in one embodiment are pivotally connected to the frame assembly 20 to enable folding the handlebars to a position generally parallel with the first and second frame members 22, 26 of the frame assembly 20 for ease of transport or storage. In other embodiments, the handlebars 80, 82 are removably connected to the frame assembly 20 by being threadedly secured in bores provided in first and second frame members 22, 26.

In operation, the wheelchair glider 10 is operated under human power. In one embodiment, a wheelchair 12 is moved up the front or rear ramp 44, 46 and onto the platform 40. The locking mechanism (which in its simplest form may be a lever 56 pivotally secured to frame 20 and selectively engageable to slot 60 in platform 40 to prevent platform 40 movement when desired) for the platform 40 should be engaged to prevent the movement of the platform 40 as the wheelchair is moved onto the platform 40. Whenever the wheelchair engages either ramp 44, 46, in the embodiment in which the ramps 44 and 46 are pivotally connected to the platform 40, the ramps 44 and 46 will be forced downwardly by the wheelchair to engage the surface supporting the wheelchair glider 10 so as to provide a smooth upwardly extending ramp on which the wheelchair may be rolled upwardly onto platform 40. Once the wheelchair 12 is positioned on platform 40, the ramps 44, 46 will be biased as above mentioned into their upward position allowing platform 40 to swing without engaging the surface on which the wheelchair glider 10 is supported. A locking mechanism (which in its simplest form may be a wheel well 62 in which the wheels of the wheelchair 12 are fixedly positioned when locking) may be provided on the platform 40 for engaging the wheelchair 12 as it sits on the platform 40. After releasing the lock 56, a user 14 may apply hand pressure to one or both handlebars 80, 82 to alternatively push and/or pull against the handlebars and cause the platform 40 to bias in relation to the frame assembly 20, swinging back and forth. In addition, or alternatively, the user 14 may apply foot pressure to push against the foot rest assembly 70 in order to bias the platform 40 in relation to the frame assembly 20. When complete, the locking mechanism 56, if any, is re-engaged so that the wheelchair 12 may be unloaded from the platform 40. In one embodiment, the wheelchair glider 10 has a front ramp 44 and the wheelchair 12 may be unloaded by advancing it forward in the same direction, i.e. without turning around on the platform or being moved in reverse. In other embodiments, the wheelchair 12 has clearance above the foot rest assembly 70 to pass over it. In yet other embodiments, the foot rest assembly 70 is removed or collapsed to enable the wheelchair to unload from the platform.

While various specific structural versions of the invention have been shown and described for purposes of illustration, the protection afforded by any patent which may issue upon this application is not strictly limited to the disclosed embodiments, but rather extends to all structures, arrangements, and methods which fall fairly within the scope of the claims which are appended hereto:

What is claimed is:

1. A wheelchair glider comprising a frame assembly having a front end and a rear end, and a platform configured to support at least one wheelchair thereupon, said platform being swingingly suspended substantially horizontally within said frame assembly by a swing arm assembly, said frame assembly comprises first and second frame members fixed in substantially parallel spaced relation to each other by at least cross brace extending therebetween, said platform being swingingly suspended from said first and second frame members by said swing arm assembly, said platform comprises a left side proximate to said first frame member and a right side proximate to said second frame member, said swing arm assembly comprising a plurality of left-side swing arms connecting said left side and side first frame member and a plurality of right-side swing arms connecting said right side and said second frame member, said left-side swing arms each having a top end pivotally connected to said first frame member and a lower end pivotally connected to said left side, said right-side swing arms each having a top end pivotally connected to said second frame member and a lower end pivotally connected to said right side, said left-side swing arms being laterally spaced apart along said left side and said first frame member, said right-side swing arms being laterally spaced apart along said right side and said second frame member.

2. The wheelchair glider of claim 1 further comprising at least one ramp provided at either a front end or a rear end of said platform, each said ramp being configured to facilitate loading and unloading a wheelchair onto and from said platform from a surface on which said glider is supported.

3. The wheelchair glider of claim 2 comprising a front ramp provided at said front end and a rear ramp provided at said rear end.

4. The wheelchair glider of claim 3 wherein said ramps are pivotally secured to said platform at said front end and said rear end, respectively and biased into an at rest position spaced above the surface supporting said wheelchair glider.

5. The wheelchair glider of claim 2 wherein each said ramp is removably secured to said platform at said front end or said rear end.

6. The wheelchair glider of claim 1 comprising at least one left-side swing arm having its said top end being pivotally connected to said first frame member proximate to said front end of said frame assembly, at least one left-side swing arm having its said top end being pivotally connected to said first frame member proximate to said rear end of said frame assembly, at least one right-side swing arm having its said top end pivotally connected to said second frame member proximate to said front end of said frame assembly, and at least one right-side swing arm having its said top end pivotally connected to said second frame member proximate to said rear end of said frame assembly.

7. The wheelchair glider of claim 6 comprising two said left-side swing arms and two said right-side swing arms.

8. The wheelchair glider of claim 7 wherein said lower ends of each said left-side swing arm are spaced apart a distance less than the distance between said top ends of each said left-side swing arm, and wherein said lower ends of each said right-side swing arm are spaced apart a distance less than the distance between said top ends of each said right-side swing arm.

9. The wheelchair glider of claim 7 wherein said lower ends of each said left-side swing arm are spaced apart a distance substantially equal to the distance between said top ends of each said left-side swing arm, and wherein said lower ends of each said right-side swing arm are spaced apart a distance substantially equal to a the distance between said top ends of each said right-side swing arm, said left-side swing arms and said right-side swing arms being generally perpendicular to said platform and said first and second frame members when said platform is at rest.

10. The wheelchair glider of claim 1 further comprising a foot rest assembly provided at said front end of said frame assembly and configured to receive at least one foot of a person sitting in a wheelchair supported by said platform and to permit said user to bias said platform in a back-and-forth swinging motion within said frame assembly by pushing on said foot rest assembly with said at least one foot.

11. The wheelchair glider of claim 10 wherein said foot rest assembly comprises an assembly support member, and an inclined foot rest connected to said assembly support member by a connecting support member.

12. The wheelchair glider of claim 11 wherein said foot rest assembly further comprises means for adjusting the height of said inclined foot rest above the surface on which said assembly support member is supported.

13. The wheelchair glider of claim 10 wherein said foot rest assembly is connected to said frame assembly and is configured for collapsing for storage and transport.

14. The wheelchair glider of claim 1 further comprising first and second handlebars secured to said first fame member and said second frame member, respectively, proximate to said front end of said frame assembly, said handlebars extending generally upwardly from said frame assembly.

15. The wheelchair glider of claim 14 wherein each said handlebar comprises a distal end, said handlebars each being configured for adjusting the height of each said distal end above said frame assembly.

16. The wheelchair glider of claim 15 further comprising a handle-gripping portion secured to each said distal end.

17. The wheelchair glider of claim 14 wherein each said handlebar is pivotally connected to said first frame member and said second frame member, respectively, such that each said handlebar may be folded into a position generally parallel with said first frame member and said second frame member, respectively.

18. The wheelchair glider of claim 14 wherein each said handlebar is removably connected to said first frame member and said second frame member, respectively.

* * * * *

UNITED STATES PATENT AND TRADEMARK OFFICE
Certificate

Patent No. 6,929,553 B1 Patented: August 16, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Kelcey Diemert, Chinook, MT (US); and John C. Iverson, Stayton, OR (US).

Signed and Sealed this Twenty-sixth Day of March 2013.

DAVID L. LEWIS
*Supervisory Patent Examiner*
Art Unit 3714
Technology Center 3700